United States Patent [19]

Belton

[11] 4,370,941

[45] Feb. 1, 1983

[54] APPARATUS FOR BATIKING EGGS AND THE LIKE

[76] Inventor: Betty R. Belton, 1007 N. Grand, Ellsworth, Kans. 67439

[21] Appl. No.: 246,645

[22] Filed: Mar. 23, 1981

[51] Int. Cl.[3] ..... B05C 17/10

[52] U.S. Cl. ..... 118/13; 118/200; 118/202; 118/506

[58] Field of Search ..... 118/200, 506, 13, 202; 15/104 R, 104 S, 257.05

[56] References Cited

U.S. PATENT DOCUMENTS 351,748 11/1886 Dengman ..... 118/202
810,640 1/1906 Greener ..... 15/257.05
4,169,908 10/1979 Hatfield ..... 118/200 X

FOREIGN PATENT DOCUMENTS 157320 12/1904 Fed. Rep. of Germany ... 15/257.05

*Primary Examiner*—John P. McIntosh

*Attorney, Agent, or Firm*—John H. Widdowson

[57] ABSTRACT

Apparatus and process for batiking eggs, articles, or the like. The apparatus has an open top container including a plurality of walls, a receptacle for holding a wax; and a clamp sildably, removably lodging over an edge of one of the walls and having the receptacle secured thereto. A burner is for positioning under the receptacle for melting the wax. A teardropping apparatus for dipping into the molten wax in order to designly deposit molten wax onto the eggs, articles, or the like. The process comprises placing wax into the receptacle; melting the wax by placing the burner under the receptacle and heating same; and dipping the teardropping apparatus into the molten wax. One of the user's hands which holds the teardropping apparatus rests on the edge of one of the walls while the other hand of the user holds the egg, article, or the like; and subsequently, the molten wax is deposited from the teardrop apparatus onto the eggs, articles, or the like.

3 Claims, 10 Drawing Figures

FIG. 1
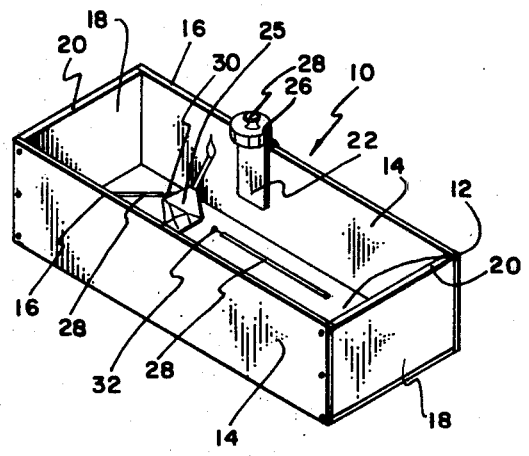
FIG. 2
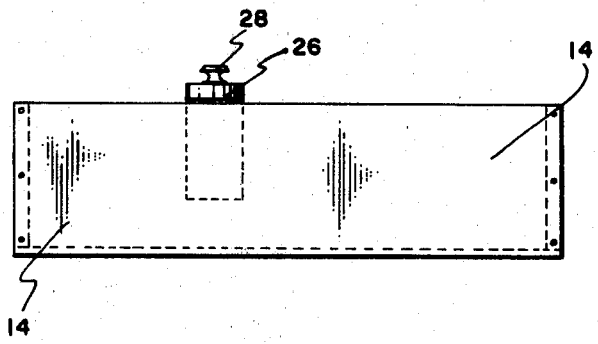
FIG. 3
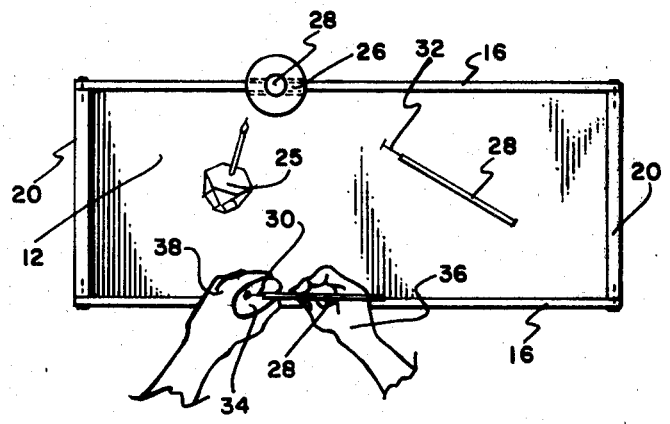
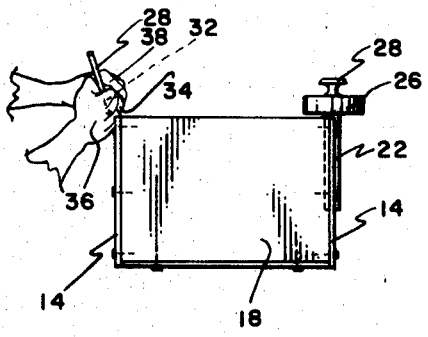
FIG. 4

APPARATUS FOR BATIKING EGGS AND THE LIKE

BACKGROUND OF THE INVENTION

1. Field of the Invention

This invention is related to batiking. More specifically, this invention provides for an apparatus for batiking and method for same.

2. Description of the Prior Art

U.S. Pat. Nos. 1,952,612 and 1,982,820 by Sherwood and Lowenstein, respectively, relate to egg dyeing wherein a variegated coloration is applied to the shell of the egg. U.S. Pat. No. 4,181,745 by Growe et al discloses dyeing egg shells wherein the shell was coated by immersing the egg in a coating material that is of dry granular form. U.S. Pat. No. 2,074,376 by Reid relates to egg coloring. U.S. Pat. No. 1,087,101 by Berry discloses a support means to support a receptacle over the chimney of an oil lamp so that the receptacle and contents thereof may be heated. U.S. Pat. Nos. 460,860 and 946,690 by Gardner and Szakall, respectively, are also directed to liquid burners having a support for a vessel that is to be heated. None of the foregoing prior art teach or suggest the particular batik means and method of this invention.

SUMMARY OF THE INVENTION

This invention accomplishes its desired objects by providing a novel batik means and method. The apparatus for batiking eggs, articles, or the like comprises an open top container means including a plurality of walls; a receptacle means for holding a wax means; a clamp means slidably, removably lodging over an edge of one of the walls and including the receptacle means secured thereto; burner means for positioning under the receptacle means for melting the wax means into a molten state; and teardropping means for dipping by the user of the batiking apparatus into the molten wax means in order to designly deposit the molten wax means onto the egg, article, or the like, while the user's hand which holds the teardropping means rests on an edge of one of the walls and the remaining user's hand holds the egg, article, or the like, in the process of decorating the same. The method comprises the steps of: placing wax means into the receptacle means; melting the wax means by placing the burner means under the receptacle means and heating same; dipping a teardropping means into the molten wax means and designly depositing the molten wax means onto the egg, article, or the like; and resting the batik apparatus user's hand which holds the teardropping means on the edge of one of the walls while the other user's hand holds the egg, article, or the like, for decorating. Subsequently, the molten wax means is deposited from the teardropping means onto the egg, article, or the like to design and decorate same.

It is an object of this invention to provide a novel batik means which is capable of easily being assembled and disassembled and stored.

It is another object of this invention to provide a novel batik method.

Still further objects of the invention reside in the provision of a batik means which can be easily transported and is relatively inexpensive to manufacture.

These together with the various ancillary objects and features will become apparent as the following description proceeds, are attained by this invention, preferred embodiments being shown in the accompanying drawings, by way of example only, wherein:

BRIEF DESCRIPTION OF THE DRAWINGS

FIG. 1 is a perspective view of the invention;

FIG. 2 is a side elevational view of the invention;

FIG. 3 is a top plan view of the invention;

FIG. 4 is an end elevational view of the invention;

DETAILED DESCRIPTION OF THE INVENTION

Figure 5:
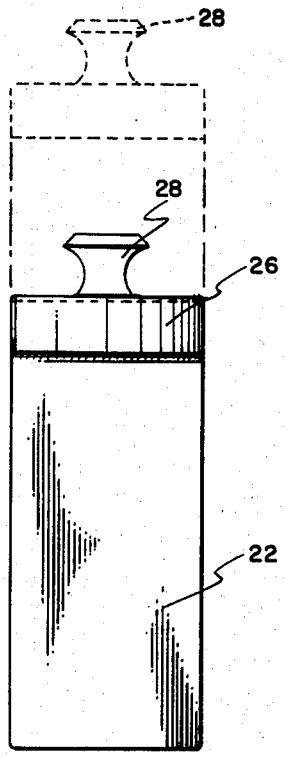
FIG. 5 is a side elevational view of the combined receptacle-clamp means including the lid for the receptacle.
Figure 6:
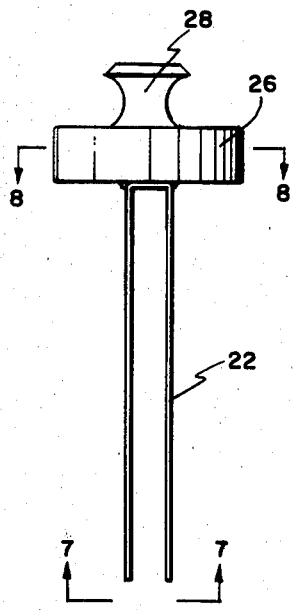
FIG. 6 is an end elevational view of the combined receptacle-clamp means and lid.
Figure 7:
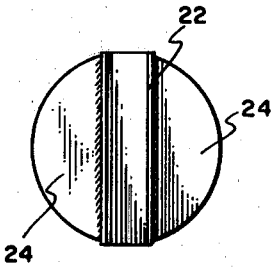
FIG. 7 is a horizontal view in direction of the arrows along the plane of line 7—7 in FIG. 6.
Figure 8:
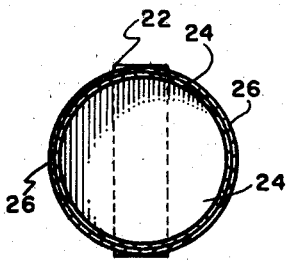
FIG. 8 is a horizontal sectional view taken in direction of the arrows and along the plane of line 8—8 in FIG. 6.
Figure 9:
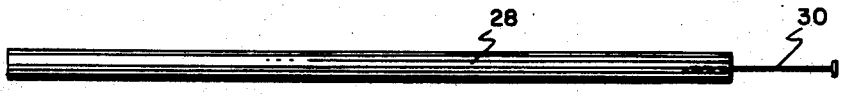
FIG. 9 is a dowel with a pin inserted in an end for minute teardropping of the melted wax.
Figure 10:
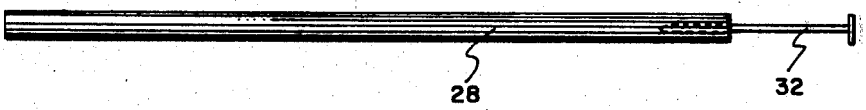
FIG. 10 is another dowel with a nail inserted in an end for forming larger teardrops of the melted wax than with the dowel in FIG. 9

Referring in detail now to the drawings wherein like reference numerals identify similar parts of the invention, my novel batik apparatus, generally illustrated as 10, is generally a rectangular box having a bottom 12, a pair of opposed side walls 14—14 with edges 16—16, and a pair of opposed end walls 18—18 with edges 20—20. An inverted U-shaped clamp 22 slidably, removably lodges on and along an edge 16 or an edge 20. A cylindrical cup 24 (see FIGS. 7 and 8) is affixed to the inverted U-shaped clamp 22 and holds wax (preferably beeswax or the like) which is to be melted into a molten state when a burner 25, preferably an alcohol burner (see FIG. 1), has its flame positioned under the cylindrical cup 24. A lid 26 with know 28 is removably positioned over the cup 24 and functions to smother a fire within cup 24 in the event of kindling of the wax in the cup 24 while being heated by the burner 25. Dowel means 28—28 having a pin 30 or a nail 32 (see FIGS. 9 and 10) functions as a wax teardropping means when the pin 30 or nail 32 (which produces a larger teardrop than pin 30) is dipped into the molten wax in order to designly deposit for solidifying the molten wax onto an egg 34, or other article, while the batik apparatus 10 user's hand 36 holding the dowel means 28 rests on edge 16 (or edge 20) and the remaining user's hand 38 holds the egg 34 while also resting on edge 16 (or edge 20), to provide support and steadiness for hands 36–38 in the process of decorating the egg 34, or the like.

With continuing reference to the drawings for operation of the invention and the process for batiking an egg 34, an article, or the like, a beeswax (or a colored wax crayon material for contrast purposes against a white background) is placed in the cylindrical cup 24. The flame of the burner 25 is placed under the cup 24 (with the lid 26 removed) in order to melt the wax into a molten state. The egg 34 to be colored should preferably be washed with or in vinegar before boiling to help the colored dye (e.g. vegetable dyes, aniline, or etc.) to adhere to the egg; or in the alternative, vinegar (or the like) should be added to the dye to aid in the adherence of the dye. Subsequently, a desired design is sketched on the egg 34 with a pencil, or the like. The user of the batik apparatus 10 picks up the egg 34 in one of his hands (36 or 38) and rests the hand (36 or 38) holding the egg 34 on edge 16 or 20 to steady the hand (36 or 38); and the remaining hand (36 or 38) of the user grasps the dowel means 28 (with pin 30 or nail 32, depending on the size of molten teardrop wax desired) and dips the pin 30 or nail 32 into the molten wax for subsequent teardropping of the molten wax onto the shell of the egg 34 while the remaining hand (36 or 38) rests on edge 16 or 20 in order to steady the hand (36 or 38) to facilitate the application of the teardropped molten wax to the egg 34. After the molten wax on the egg 34 solidifies, the egg 34 may subsequently be dipped into a coloring dye solution for coloring the portions of the shell of the egg 34 not having any wax adhered thereto; the solidified wax protects the underlying shell of the egg 34, or the underlying color beneath the solidified wax in the event that the egg 34 is dipped into a coloring dye solution prior to teardropping molten wax onto the colored shell of the egg 34. Various colors can be derived on the surface of the shell of the egg 34 in this stepwise process of waxing, dipping into a dye solution, subsequently waxing again, and subsequently dipping again into another dye solution. After each color dip, more wax may be added to prevent any subsequent coloring (from dipping) from adhering to and discoloring any previous color that was applied to the egg 34 from a prior color dipping; the underlying color is retained wherever the wax is teardropped and solidified. After the steps of wax designing and dipping into colors are completed, the egg 34 my be dewaxed by holding the egg 34 over the burner 25 to soften the wax on the shell of the egg 34 for subsequent wiping (e.g. with a paper towel) to reveal the design colors. Of course it is obvious that the foregoing procedure can be reversed; that is, selected portions of the egg 34 can be waxed such that dyes will not affect the surface, and thereafter removing portions of the wax by heating with burner 25 to allow additional colors to be applied to the now, unwaxed portions.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I CLAIM:

1. An apparatus for batiking eggs, articles, or the like, comprising an open top container means including a plurality of walls; a receptacle means for holding a wax means; a clamp means slidably, removably lodging over an edge of one of said walls and including said receptacle means secured thereto; burner means for positioning under said receptacle means for melting said wax means into a molten state; and wax teardropping means for dipping by the user of said batiking apparatus into said molten wax means in order to designly deposit said molten wax means onto said egg, article, or the like, while the batik apparatus user's hand holding said teardropping means rests on an edge of one of the walls and the remaining user's hand holds the egg, article, or the like, in the process of decorating the same; a lid means for removably positioning over said receptacle means in the event of kindling of said wax means within said receptacle means while being heated into a molten state by said burner means, said lid means including a wooden knob means secured thereto for grasping by the batik apparatus user in removing the lid means from the receptacle means; said clamp means comprises a structure defining a U-shape, said U-shaped clamp being inverted to slidably lodge over and along an edge of one of the walls; said receptacle means is defined by a cylindrical cup having a bottom affixed to said inverted U-shaped clamp; and said open top container means comprises a generally rectangular box having a pair of opposed end walls and a pair of opposed side walls, said inverted U-shaped clamp having said cylindrical cup secured thereto slidably lodges on and along one of said pair of opposed side walls.

2. The apparatus of claim 1 wherein said wax teardropping means comprises a dowel means having a head pin means inserted in one end.

3. The apparatus of claim 1 wherein said wax teardropping means comprises a dowel means having a nail means inserted in one end.

* * * * *